US005199392A

United States Patent [19]

Kreuter et al.

[11] Patent Number: 5,199,392

[45] Date of Patent: Apr. 6, 1993

[54] ELECTROMAGNETICALLY OPERATED ADJUSTING DEVICE

[75] Inventors: Peter Kreuter, Aachen; Klaus P. Schmitz, Lathen, both of Fed. Rep. of Germany

[73] Assignee: Audi Ag, Ingolstadt, Fed. Rep. of Germany

[21] Appl. No.: 654,645

[22] PCT Filed: Jul. 28, 1989

[86] PCT No.: PCT/DE89/00491

§ 371 Date: Apr. 23, 1991

§ 102(e) Date: Apr. 23, 1991

[87] PCT Pub. No.: WO90/01614

PCT Pub. Date: Feb. 22, 1990

[30] Foreign Application Priority Data

Aug. 9, 1988 [DE] Fed. Rep. of Germany ..... 3826978

[51] Int. Cl.[5] ..... F01L 9/04

[52] U.S. Cl. ..... 123/90.11; 251/129.1; 251/129.16

[58] Field of Search ..... 123/90.11; 251/129.01, 251/129.1, 129.16

[56] References Cited

U.S. PATENT DOCUMENTS

| | | | |
|---|---|---|---|
| 4,544,986 | 10/1985 | Buchl | 123/90.11 |
| 4,715,332 | 12/1987 | Kreuter | 123/90.11 |
| 4,841,923 | 6/1989 | Buchl | 123/90.11 |
| 4,846,120 | 7/1989 | Buchl | 123/90.11 |
| 4,878,464 | 11/1989 | Richeson, Jr. et al. | 123/90.11 |
| 4,883,025 | 11/1989 | Richeson, Jr. | 123/90.11 |
| 5,080,323 | 1/1992 | Kreuter | 123/90.11 |

FOREIGN PATENT DOCUMENTS

| | | | |
|---|---|---|---|
| 0197357 | 1/1989 | European Pat. Off. . | |
| 3513105 | 1/1974 | Fed. Rep. of Germany . | |
| 3500530 | 7/1986 | Fed. Rep. of Germany | 123/90.11 |
| 2335150 | 10/1986 | Fed. Rep. of Germany . | |

*Primary Examiner*—E. Rollins Cross
*Assistant Examiner*—Weilun Lo
*Attorney, Agent, or Firm*—Jacques M. Dulin; Thomas C. Feix

[57] ABSTRACT

An actuator assembly for an electromagnetically-actuated, spring-loaded positioning system in displacement engines, such as for lifting valves in internal combustion engines. The positioning mechanism comprises a three-spring system and two electrically-operated, opposed actuating solenoids, by means of which the actuator may be moved therebetween, and held at, two discreet, mutually-opposite operating positions. The actuator assembly further comprises an anchor plate having integrally attached upper and lower stems, wherein the lower stem engages the upper flanged end of a valve stem and, upon reciprocation of the anchor plate, transfers movement to the valve stem which moves the valve from a closed to an open position, or vice-versa. The actuator assembly is symmetrically biased by upper and lower halves of the three-spring system. The upper spring system includes a first spring disposed to engage the upper stem and stressed to force the actuator assembly to the open position of the valve head. The lower spring system comprises: A second spring disposed to engage the lower stem and stressed to move the actuator assembly to the closed position of the valve head; and A third spring disposed to engage a stamp flange on the upper end of the valve stem which spring is stressed to assist the second spring in moving the actuator assembly to the closed position of the valve head. Spring constants of each spring are selected to provide a constant neutral point of the spring system over the service life of the actuator assembly.

9 Claims, 1 Drawing Sheet

ELECTROMAGNETICALLY OPERATED ADJUSTING DEVICE

FIELD

The invention relates generally to an improved electromagnetically operated adjusting device for spring-loaded reciprocating actuators in displacement engines, such as for lifting gas exchange valves of internal combustion engines. More particularly, the invention relates to improvements of the spring system associated with the electromagnetically operated adjusting device whereby an additional spring associated with one of the two solenoid members is provided to retard the material fatigue and aging processes associated with conventional two-spring systems so that the spring system tension does not change over a long operating lifetime thus ensuring constant operating conditions of the gas exchange valve.

BACKGROUND

Examples of electromagnetically operated adjusting devices for gas exchange valves of this type are shown in EP-A 0 197 357, DE-OS 35 13 105 and DE-OS 23 35 150.

These known examples disclose an anchor plate which is caused to oscillate back and forth between and engage the pole surface associated with a pair of opposed electromagnets. Each electromagnet has disposed therein a solenoid which, when energized, provides current flow through the electromagnet and attracts the anchor plate to its corresponding pole surface. The anchor plate includes an extension member adapted to transfer movement to a valve stem of a gas exchange valve such that the contact of the anchor plate with a pole surface of either electromagnet results in either a closed or open position of the gas exchange valve. A spring system comprising a first spring disposed above the anchor plate and located about the central axis of the actuator assembly and a second spring disposed below the anchor plate and also located about the central axis of the actuator assembly, is provided to assist the movement of the anchor plate towards the pole surface of the opposing electromagnet as the associated solenoid is de-energized. The neutral or dead point of this spring system is located at about the central position of the anchor plate between the two opposing electromagnets.

During operation, if the anchor plate is in contact with one of the two electromagnets, then the spring system moves the anchor plate away from the pole surface of the contacted electromagnet as the solenoid associated with that electromagnet is de-activated. This permits the spring system to oscillate the anchor plate out past the dead point to the opposite electromagnet. If the opposite electromagnet is then excited by current (i.e., its solenoid is energized), the anchor plate gets caught and engages the pole surface of the opposing electromagnet. The change of position of the anchor plate activates the gas exchange valve to switch from an open to a closed position, or vice-versa.

DE-A 35 13 105 and EP-A 0 197 357 also disclose valve systems wherein the anchor plate is stressed symmetrically at both ends. Symmetrical stressing is provided by a pair of springs or packs of springs such that when either electromagnet is energized, the dead point of the spring system sits in the middle between the opposed electromagnets, thus making possible a symmetrical opening or closing of the gas exchange valve. One side of the symmetrical spring system presses directly against a structured piece (stem) that forms a unitary part of the anchor plate or against the anchor plate itself, while the opposite spring system presses against the valve tappet which in turn presses against the anchor plate, moving it again into its middle position. Difficulties arise in such systems from the aging of the springs and general wear and tear, so that after a certain period of operation the position of the mid-point of the system is no longer assured.

Therefore there is a definite need in the art to provide an improved spring system in electromagnetically operated adjusting devices for use in gas exchange valves for internal combustion engines which do not fatigue or weaken or undergo changes over a long operating lifetime.

THE INVENTION

Objects

It is among the objects of the invention to provide an improved electromagnetically operated gas exchange valve actuator assembly wherein the constant spring properties of the spring system are ensured over long operating lifetimes.

It is another object of the invention to provide an improved adjusting device for gas exchange valves whereby an additional spring is provided along one side of the anchor plate to facilitate in moving the gas exchange valve to the closed position and whereby the overall spring system still retains a neutral dead point corresponding to the half way point position of the anchor plate resting between the two opposed electromagnets.

Still other objects will be evident from the following specification, drawing and claims.

DRAWINGS

The invention is described in more detail by reference to the drawing in which:

The FIGURE is a cross-sectional elevation view of the adjusting device of this invention.

SUMMARY

Pursuant to the invention, a three-spring system is provided in the adjusting device for the gas exchange valves wherein two of these springs are conventionally disposed on either side of the reciprocating anchor plate, and a third spring is provided on the lower portion of the actuator assembly to bias the gas exchange valve into the closed position of the valve head.

The anchor plate for the valve stem is disposed to reciprocate between two opposed electromagnets and is biased on either side by the three-spring system. The anchor plate is provided with an upper axial stem which includes a bore hole for receiving therein a first upper spring, which upper spring is stressed to force the anchor plate towards the lower electromagnet and hence move the gas exchange valve into the open position. The anchor plate is also provided with a lower axial stem which has an enlarged terminal flange which is biased by a second lower spring, which second lower spring is stressed to force the anchor plate towards the upper electromagnet and hence move the gas exchange valve into the closed position. The third spring is provided to the lower half of the spring system and is disposed to abut against the cylinder head at its lower end and against the stamp flange end portion of the valve stem at its upper end, and is stressed to force the gas exchange valve to the closed position. The lower stem flange has a larger diameter than the stamp flange (tappet).

Thus, the lower spring system is divided into a first spring that works on the valve stem and a second spring that works on a structural piece integral with the anchor plate (i.e., the lower stem). The three spring system provides for reliability of precise actuator movement of the two main reciprocating bodies of the actuator system, namely the anchor plate (and associated upper and lower integral anchor plate stems) and the valve stem.

The anchor plate, being separable from the stamp portion of the valve stem is kept in constant contact with the stamp portion by means of the third additional lower spring. The spring constants associated with the two springs of the lower spring system are selected to balance the spring force of the upper spring so that the neutral or dead point of the spring system is in the middle, i.e., where the actuator plate comes to rest in the middle between the two opposed electromagnets.

Due to this division of the spring system according to their different functions, a constant neutral point of the spring system is achieved over the service life of the actuator assembly.

DETAILED DESCRIPTION OF THE BEST MODE

Figure 1:
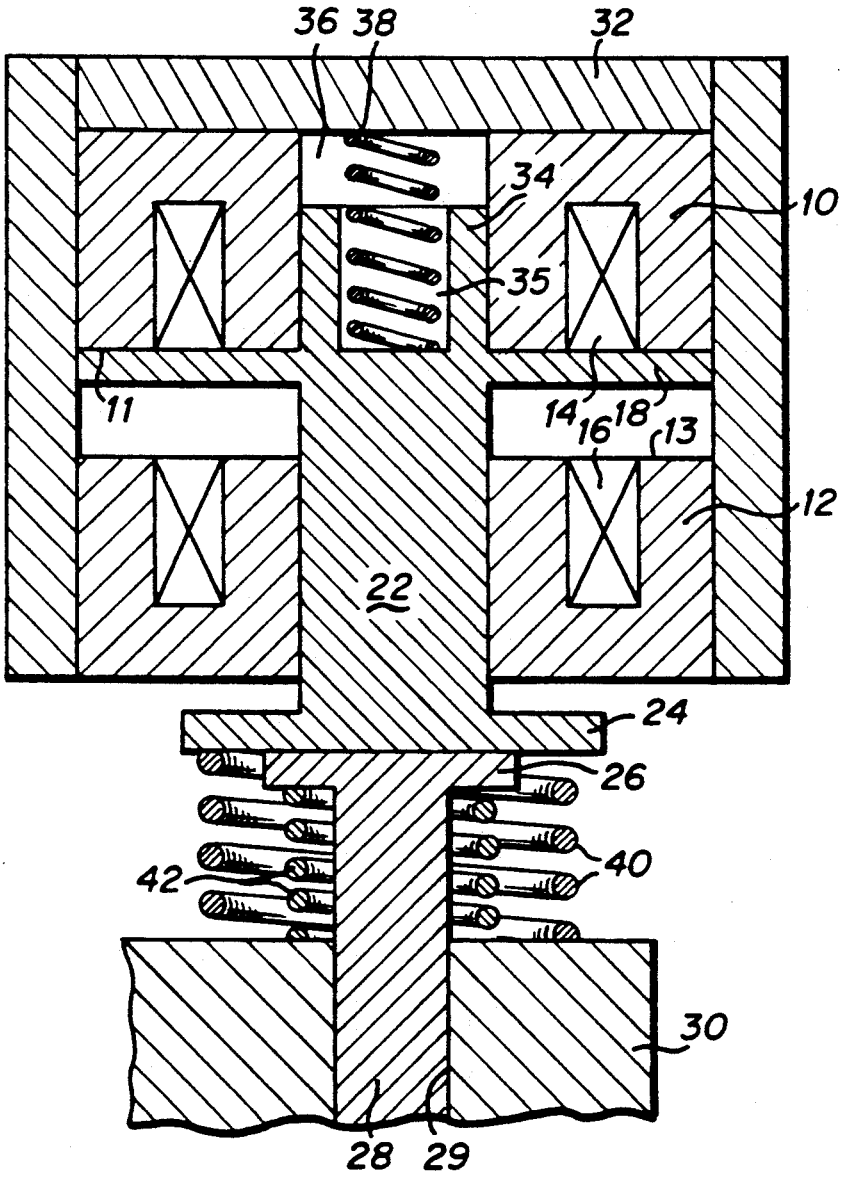

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

The figure illustrates the improved solenoid, spring-biased adjusting device of this invention. The adjusting device comprises two magnet cores 10 and 12 which are designed as shielded electromagnets and contain coils or solenoids 14 and 16, respectively.

By way of reference to the orientation of the elements in the following description, the distinctions between up and down and top and bottom will refer to the normal convention. In other words, iron core 10 will hereafter be referred to as the upper or top iron core and iron core 12 as the lower or bottom iron core.

The two shielded electromagnets 10 and 12 have associated therewith pole surfaces 11 and 13, respectively. Anchor plate 18 is medially disposed between pole surfaces 11 and 13, and during operation, reciprocates back and forth therebetween, alternately engaging each pole surface as current flows through the corresponding electromagnet. The actuator assembly is further defined by a center drilled bore hole 36 which is disposed to run through both upper and lower electromagnets 10 and 12 and is adapted to receive upper and lower protrusions 34 and 22, both of which are integrally associated with the anchor plate 18. The outer diameter of both upper stem 34 and lower stem 22 are sized to permit relatively frictionless travel within the bore hole 36 and provide controlled up and down reciprocating movement to the anchor plate 18.

An outer perimeter casing 20 surrounds the actuator assembly and serves as an outer shield to prevent excessive thermal stress and/or electromagnetic forces from interfering with the electromagnet switching movement of the actuator assembly. The outer casing 20 also serves to guide the up and down reciprocating movement of the anchor plate 18. A top cover 32 is provided to seal off the bore hole 36 on the top iron core 10.

At the lower end of protrusion 22 is an integral flanged stop member 24. Stop member 24 is adapted to remain in constant contact with the stamp end flange 26 of valve stem 28. As in any conventional gas exchange system associated with internal combustion engines, the valve stem 28 has on its opposing end (not shown) a valve head that opens or closes the inlet or outlet for the combustion chamber of an internal combustion engine in the known manner. The valve stem reciprocates up and down with in a hole 29 provided in the cylinder head 30.

The anchor plate 18 is biased downward by a first upper spring 38. A bore 35 is provided within upper stem 34 and is sized to receive coil spring 38 and provides a point of abutment for the bottom end of coil spring 38. The aforementioned top cover 32 provides the other (upper) point of abutment for coil spring 38. As is illustrated in the Figure, coil spring 38 is being compressed while anchor plate 18 is in contact with the pole surface 11 associated with upper electromagnet 10. This corresponds to the condition when upper solenoid 14 is being energized and current is flowing through the electromagnet 10. As current is cut off to the upper electromagnet 10 (i.e. when the solenoid 14 is deactivated) the compressed spring 38 forces the anchor plate 18 downward out beyond the neutral point of the spring system where it will be drawn by magnetic attraction towards the pole surface of lower electromagnet 12 (assuming lower solenoid 16 has been energized).

The position of the anchor plate 18 as shown in the Figure corresponds to the closed position of the, gas exchange valve. This is the case for both intake and exhaust gas exchange valves.

A second or lower spring system,.presented here as coil springs 40 and 42 are provided to force the anchor plate 18 into a position that corresponds to the closed position of the gas exchange valve. That is, springs 40 and 42 become compressed as the anchor plate is moved towards pole surface 13 associated with lower electromagnet 12. As is seen in the Figure, both coil springs 40 and 42 abut the top surface of cylinder head 30 at their lower ends. Coil spring 40 abuts the lower surface of the flanged stop member 24 at its upper end, and coil member 42 abuts the bottom surface of the stamp end flange 26 of the valve stem 28.

The entire three spring system is designed to have an equilibrium position of the anchor plate 18 that is about in the middle between the two opposing pole surfaces 11 and 13 of electromagnets 10 and 12, respectively.

In the preferred embodiment, upper spring 38 is stiffer (i.e., has a stronger spring constant) than spring 40, and the lower portion of the spring system is bolstered to compensate the spring stiffness of spring 38 by the additional spring 42. The addition of spring 42 ensures that contact will always exist between the flanged stop member 24 and the stamp end 26 of the valve shaft under all operating conditions. Thus, even when the gas exchange valve is in the closed position (i.e., when the anchor plate 18 contacts pole surface 11 as shown in the Figure) spring 42 is still exerting some spring force in the upward direction to keep the stamp end 26 in contact with the stop member 24.

The contact between the stop member 24 and the stamp end 26 of the valve stem 28 can also be ensured for longer operation by using commonly available hydraulic valve lifters or valve-play compensation elements in the region between the contact points of stop member 24 and the stamp end 26. Such valve-play compensation elements are generally known from valve engineering principals on internal combustion engines and may be used in combination with this invention.

The operation of the adjusting feature will be described as follows:

Starting from the position where the anchor plate 18 is in contact with the upper shielded electromagnet 10 (as illustrated in the Figure) coil 14 is now energized and spring 38 is compressed while springs 40 and 42 are essentially relaxed. This corresponds to the closed position of the gas exchange valve.

To open the gas exchange valve, solenoid 14 is de-energized while solenoid 16 is simultaneously energized. As the current flow is cut-off to the electromagnet 10, the rapidly decaying magnetic force which attracts the anchor plate 18 to pole surface is overcome by the compressive spring force of spring 38. This in turn, causes the downward movement of anchor plate 18 towards the opposing pole surface 13 associated with electromagnet 12.

As the spring system moves "downward" beyond the dead point, the anchor plate 18 is attracted to the pole surface 13 of shielded electromagnet 12 by the introduction of current flow through solenoid 16. In this condition spring 38 is relaxed and springs 40 and 42 are compressed. Since the anchor plate 18 has been shifted downward by the distance between the two electromagnets 10 and 12 (minus its own thickness), the valve stem 28 is accordingly moved (pushed) downward by this amount and thus opens the valve head of the gas exchange valve.

To re-close the gas exchange valve, the above process is exactly reversed, that is, lower solenoid 16 is de-activated while upper solenoid 14 is energized. The process repeats with the valve oscillating under control of current to the solenoids.

In the preferred embodiment, springs 38 and 40, being of different lengths, have different spring constants. The stiffness of each spring for the 3 spring system are selected to balance the system about a dead point where the anchor plate 18 remains in the central position between the two pole surfaces 11, 13 of the opposing electromagnets 10 and 12 such that the springs system has a vibrational movement that is essentially symmetrical to both sides.

In an alternate embodiment a fourth spring may be added to the spring system. This would be the case where the two bottom springs 40 and 42 have the same spring constants. The fourth spring would be added to the upper portion and abut against the top cover 32 at its top end, and against the upper shoulder or annular lip portion of upper stem 34 (between the bores 35 and 36) at the spring's bottom end. It is understood that the additional fourth spring would necessarily operate only over a portion of the path of the anchor plate 18.

It should be understood that various modifications within the scope of this invention can be made by one of ordinary skill in the art without departing from the spirit thereof. We therefore wish our invention to be defined by the scope of the appended claims as broadly as the prior art will permit, and in view of the specification if need be.

We claim:

1. An electromagnetically operated, spring-biased actuator assembly for gas exchange valves in internal combustion engines, comprising in operative combination:

a) a first actuating solenoid and a second actuating solenoid disposed within a perimeter housing and spaced apart to define a gap therebetween, each of said solenoids having an iron core;

b) a ferromagnetic anchor plate disposed in said gap between said actuating solenoids to be selectively attracted to and guidingly reciprocated between engagement with each of said actuating solenoids, each engagement corresponding to either the closed or open operating condition of the gas exchange valve;

c) said anchor plate including:

i) an upper and lower stem portion, each of said stem portions disposed opposite one another and coaxial with the axial center of said anchor plate, said upper stem, portion being receivingly reciprocable in a central axial bore of said first actuating solenoid and said lower stem portion being receivingly reciprocable in a central axial bore of said second actuating solenoid;

ii) said lower stem portion having a terminal flange disposed to engage a coaxially aligned stamp member of a gas exchange valve stem, said terminal flange having a diameter sufficiently large to overlap the diameter of said stamp member;

d) a spring system for symmetrically stressing said anchor plate and assisting the reciprocating movement of said anchor plate and valve stem upon the appropriate excitation of each of said actuating solenoids; and e) said spring system ensuring contact between said terminal flange portion of said anchor plate and said stamp member so that said reciprocating movement of said anchor plate is transferred to said gas exchange valve to open and close said gas exchange valve, and maintaining a constant neutral point of said spring system over the service life of the actuator assembly.

2. An electromagnetically operated, spring-biased actuator assembly as in claim 1 wherein said spring system includes:

a) a first spring having a central axis, said first spring being mounted axially aligned within said axial bore of said first actuating solenoid, said first spring including a first, upper end abutting a top enclosure of said perimeter housing and a second, lower end abutting against a portion of said upper stem portion of said anchor plate, said first spring being tensioned to urge said anchor plate away from said engagement with said first actuating solenoid;

b) a second spring mounted coaxially about a portion of said gas exchange valve stem adjacent said stamp portion, said second spring having an upper end abutting said overlap portion of said terminal flange of said lower stem portion of said anchor plate and a lower end abutting a cylinder head portion of the internal combustion engine, said second spring being tensioned to urge said anchor plate away from engagement with said second actuating solenoid; and c) a third spring mounted axially about said portion of said gas exchange valve stem adjacent said stamp portion and said second spring, said third spring having an upper end abutting said stamp portion of said gas exchange valve stem and a lower end abutting said cylinder head portion of the internal combustion engine, said third spring being tensioned to urge said valve stem towards said anchor plate.

3. An electromagnetically operated, spring-biased actuator assembly as in claim 2 wherein each of said springs has a different stiffness.

4. An electromagnetically operated, spring-biased actuator assembly as in claim 2 wherein the stiffness of said second and third springs is selected to maintain contain between said terminal flange of said anchor plate lower portion and said stamp portion of said gas exchange valve when said valve is in the closed position.

5. An electromagnetically operated, spring-biased actuator assembly as in claim 3 wherein the stiffness of said second and third springs is selected to maintain contact between said terminal flange of said anchor plate lower portion and said stamp portion of said gas exchange valve when said valve is in the closed position.

6. An electromagnetically operated, spring-biased actuator assembly as in claim 4 wherein:

a) each of said springs are coil springs;

b) said first spring is aligned coaxial to said axial center of said anchor plate; and c) said third spring has a coil diameter smaller than a coil diameter of said second spring so that said third spring nests within said second spring.

7. An electromagnetically operated, spring-biased actuator assembly as in claim 6 wherein:

a) said upper stem portion of said anchor plate is provided with an axial bore disposed to receivingly engage said lower end of said first spring.

8. An electromagnetically operated, spring-biased actuator assembly as in claim 5 wherein:

a) each of said springs are coil springs;

b) said first spring is aligned coaxial to said axial center of said anchor plate; and c) said third spring has a coil diameter smaller than a coil diameter of said second spring so that said third spring nests within said second spring.

9. An electromagnetically operated, spring-biased actuator assembly as in claim 8 wherein:

a) said upper stem portion of said anchor plate is provided with an axial bore disposed to receivingly engage said lower end of said first spring.

* * * * *